US010886637B2

(12) United States Patent
Ambo

(10) Patent No.: US 10,886,637 B2
(45) Date of Patent: Jan. 5, 2021

(54) CRIMP CONNECTION TERMINAL

(71) Applicant: DELTA PLUS CO., LTD., Mie (JP)

(72) Inventor: Tsugio Ambo, Saitama (JP)

(73) Assignee: DELTA PLUS CO., LTD., Mie (JP)

( * ) Notice: Subject to any disclaimer, the term of this patent is extended or adjusted under 35 U.S.C. 154(b) by 0 days.

(21) Appl. No.: 16/595,579

(22) Filed: Oct. 8, 2019

(65) Prior Publication Data

US 2020/0136273 A1 Apr. 30, 2020

(30) Foreign Application Priority Data

Oct. 29, 2018 (JP) ..... 2018-202968

(51) Int. Cl.
*H01R 4/18* (2006.01)
*H01R 43/048* (2006.01)
*H01R 43/16* (2006.01)

(52) U.S. Cl.
CPC ..... *H01R 4/184* (2013.01); *H01R 43/048* (2013.01); *H01R 43/16* (2013.01)

(58) Field of Classification Search
CPC ..... H01R 4/184; H01R 43/048; H01R 43/16
USPC ..... 439/887
See application file for complete search history.

(56) References Cited

U.S. PATENT DOCUMENTS 2,783,447 A * 2/1957 Watts ..... H01R 4/188 439/406
3,514,528 A * 5/1970 Ray ..... H01R 4/2495 174/84 C
3,798,347 A * 3/1974 Harding ..... H01R 4/2495 174/84 C
3,902,004 A * 8/1975 Harding ..... H01R 4/2495 174/84 C
3,916,085 A * 10/1975 Hansen ..... H01R 4/2495 174/84 C
4,142,771 A * 3/1979 Barnes ..... H01R 4/184 174/84 C
4,229,063 A * 10/1980 Yoshizawa ..... H01R 4/62 439/442
5,445,535 A * 8/1995 Phillips, Jr. ..... H01R 4/2495 439/394
8,221,171 B2 * 7/2012 Ono ..... H01R 4/185 439/877
9,397,410 B2 * 7/2016 Corman ..... H01R 4/185
9,431,720 B2 * 8/2016 Ito ..... H01R 4/182
10,003,136 B2 * 6/2018 Ohnuma ..... H01R 4/185
(Continued)

FOREIGN PATENT DOCUMENTS

JP S5138085 A 3/1976
JP S5727668 U 2/1982
(Continued)

*Primary Examiner* — Peter G Leigh
(74) *Attorney, Agent, or Firm* — Li & Cai Intellectual Property (USA) Office

(57) ABSTRACT

In a conductor crimping portion 3, a pair of crimping pieces 3*c* and 3*d* having a two-layer structure of an upper layer plate 3*a* and a lower layer plate 3*b* connecting the upper layer plate 3*a* is raised in a U-shape from both sides of a bottom portion 3*e*. A void 3*g* is formed inside a folded-back portion of the upper layer plate 3*a* from the lower layer plate 3*b*. In the conductor crimping portion 3, the crimping pieces 3*c* and 3*d* have a two-layer structure, and a conductor portion is elastically fixed and connection becomes strong due to the presence of the void 3*g*.

3 Claims, 5 Drawing Sheets

(56) References Cited

U.S. PATENT DOCUMENTS

| | | | | |
|---|---|---|---|---|
| 2014/0378011 | A1* | 12/2014 | Aizawa | H01R 4/18 439/877 |
| 2016/0028167 | A1* | 1/2016 | Hanazaki | H01R 43/048 439/877 |

FOREIGN PATENT DOCUMENTS

| | | | |
|---|---|---|---|
| JP | S6427963 | U | 2/1989 |
| JP | 2009295403 | A | 12/2009 |
| JP | 2018147828 | A | 9/2018 |

* cited by examiner

CRIMP CONNECTION TERMINAL

FIELD OF THE DISCLOSURE

The present invention relates to, for example, a crimp connection terminal internally mounted in a connector housing and fit with a connection terminal of a counterpart connector.

BACKGROUND OF THE DISCLOSURE

With a recent reduction in size, reduction in weight and integration of an electric product, a smaller connection terminal has been required as a connection terminal used for connection of a circuit. For example, a rectangular insertion portion having a diameter smaller than that of an electric wire to be connected and an outer diameter of about 0.5 mm·0.5 mm is used as a rod-shaped insertion portion inserted into a counterpart connection terminal. In addition, there is a connection terminal used for a fiber wire having a large number of extremely thin core wires.

SUMMARY OF THE DISCLOSURE

In a case in which a fiber wire is crimped to a connection terminal, since a conductor portion of the fiber wire is obtained by forming copper plating around an extremely fine fiber core wire and twisting a plurality of core wires together, the conductor portion is poor in extensibility and plasticity, and highly reliable connection to the fiber wire by the small connection terminal is fairly difficult. When the connection terminal is insufficiently fixed to the fiber wire, the fiber wire is easily pulled out of the connection terminal, and it is difficult to obtain excellent conductivity.

JP-A-2017-162792 is one conventional example for connecting the fiber wire in this way.

An object of the invention is to solve the above-mentioned problem, and provide a crimp connection terminal capable of reliably caulking and holding a conductor portion of a fiber wire by a conductor crimping portion having a unique structure and ensuring reliability of electric connection.

A crimp connection terminal according to the invention for achieving the object is a crimp connection terminal formed by punching and bending one conductive metal plate to caulk and fix an electric wire, wherein a connection portion connected to a connection terminal of a counterpart connecter is disposed at a front side, a conductor crimping portion to crimp and fix a conductor portion of the electric wire is disposed at a rear side, the conductor crimping portion has a pair of crimping pieces raised in a U-shape from a bottom portion, the crimping pieces of the conductor crimping portion have a lower layer plate and an upper layer plate formed by folding back from an end portion of the lower layer plate and stacking on the lower layer plate, and a void is formed inside the folded-back portion between the lower layer plate and the upper layer plate.

According to the crimp connection terminal according to the invention, it is possible to reliably crimp and connect a conductor portion of a fiber wire in which a plurality of core wires is twisted together to a conductor by a conductor crimping portion and to obtain excellent fixing force and conductivity.

DETAILED DESCRIPTION OF THE EXEMPLARY EMBODIMENTS

The invention will be described in detail based on an illustrated embodiment.

Figure 1:
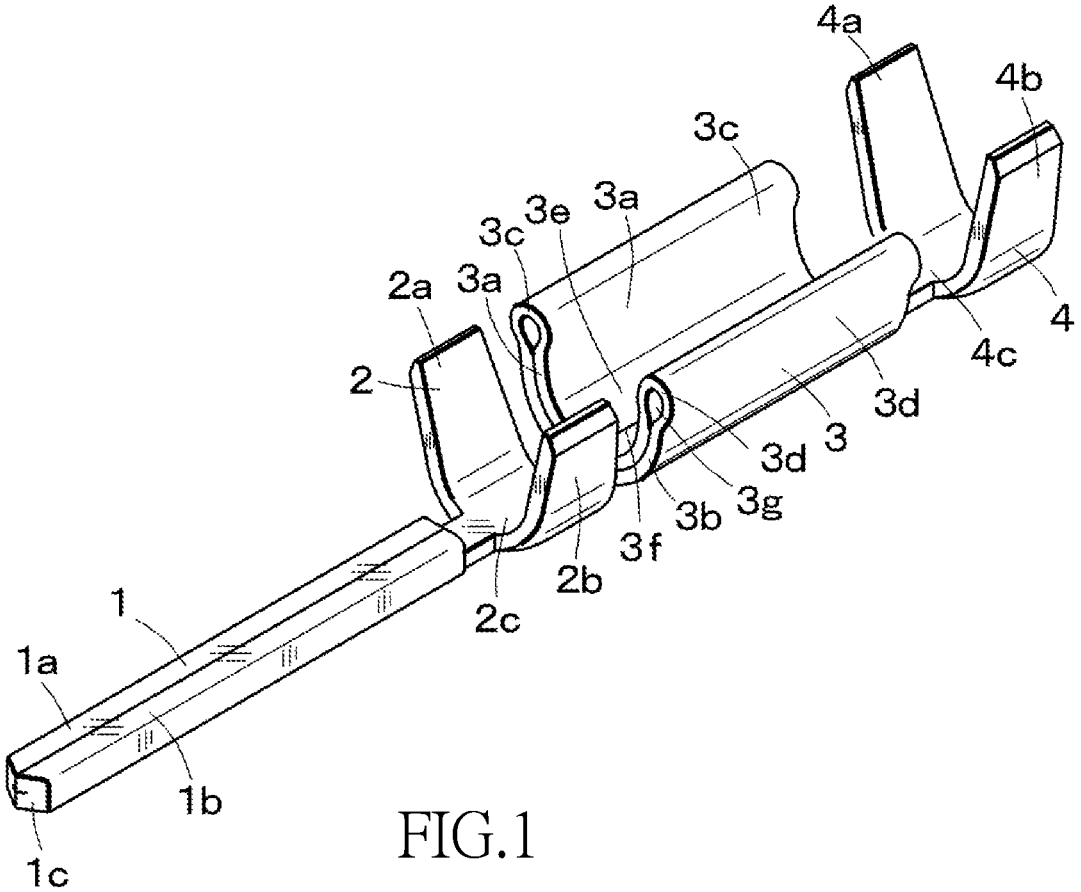
FIG. 1 is a perspective view of a crimp connection terminal of an embodiment.

FIG. 1 is a perspective view of a crimp connection terminal of an embodiment according to the invention. The crimp connection terminal is made of, for example, thin-walled brass having a thickness of 0.15 mm, and is formed by punching and bending one conductive metal plate plated with copper, tin, etc. on both surfaces.

A connection portion 1 corresponding to, for example, a male insertion portion connected to a connection terminal of a counterpart connecter is formed at a front of the crimp connection terminal, and an edge crimping portion 2, a conductor crimping portion 3, and a coated crimping portion 4 are successively disposed on a rear side thereof.

The connection portion 1 has a two-layered male insertion end structure in which the conductive metal plate is folded back from both sides and both edges of folded pieces 1*a* and 1*b* are butted to each other. However, the connection portion 1 may correspond to a male connection portion having another shape or a female connection portion.

In the edge crimping portion 2, a pair of crimping pieces 2*a* and 2*b* is raised in a U-shape obliquely upward from both sides of a bottom portion 2*c*.

Figure 2:
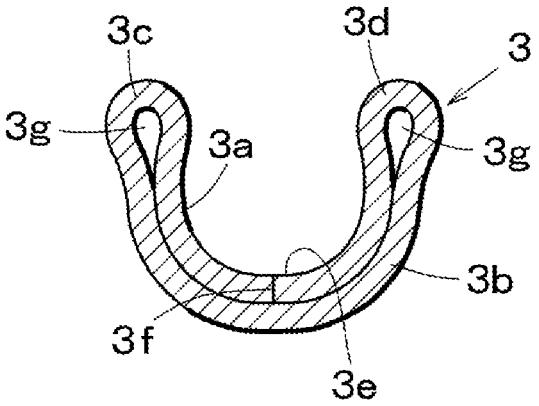
FIG. 2 is a cross-sectional view of a conductor crimping portion.

In the conductor crimping portion 3, as illustrated in FIG. 2, a pair of crimping pieces 3*c* and 3*d* having a stacked structure of an upper layer plate 3*a* and a lower layer plate 3*b* is raised in a U-shape obliquely upward from both sides. Further, the upper layer plate 3*a* is folded back from the lower layer plate 3*b* at an upper end, and end edges of the upper layer plate 3*a* are butted together at a central portion of a bottom portion 3*e* to form a joint 3*f*. A void 3*g* whose cross section corresponds to, for example, a water droplet shape, a balloon shape, a circular shape, an elliptical shape, etc. is provided inside a folded-back portion of the upper layer plate 3*a* with respect to the lower layer plate 3*b* at an upper end of each of the crimping pieces 3*c* and 3*d*.

In the coated crimping portion 4, similarly to the edge crimping portion 2, a pair of crimping pieces 4*a* and 4*b* is raised in a U-shape obliquely upward from both sides of a bottom portion 4*c*.

A stabilizer for stabilizing a posture in a connector housing, a locking portion for preventing coming off from the connector housing in a front-rear direction, etc. may be attached to an actual crimp connection terminal. However, illustration of these known mechanisms is omitted.

Figure 3:
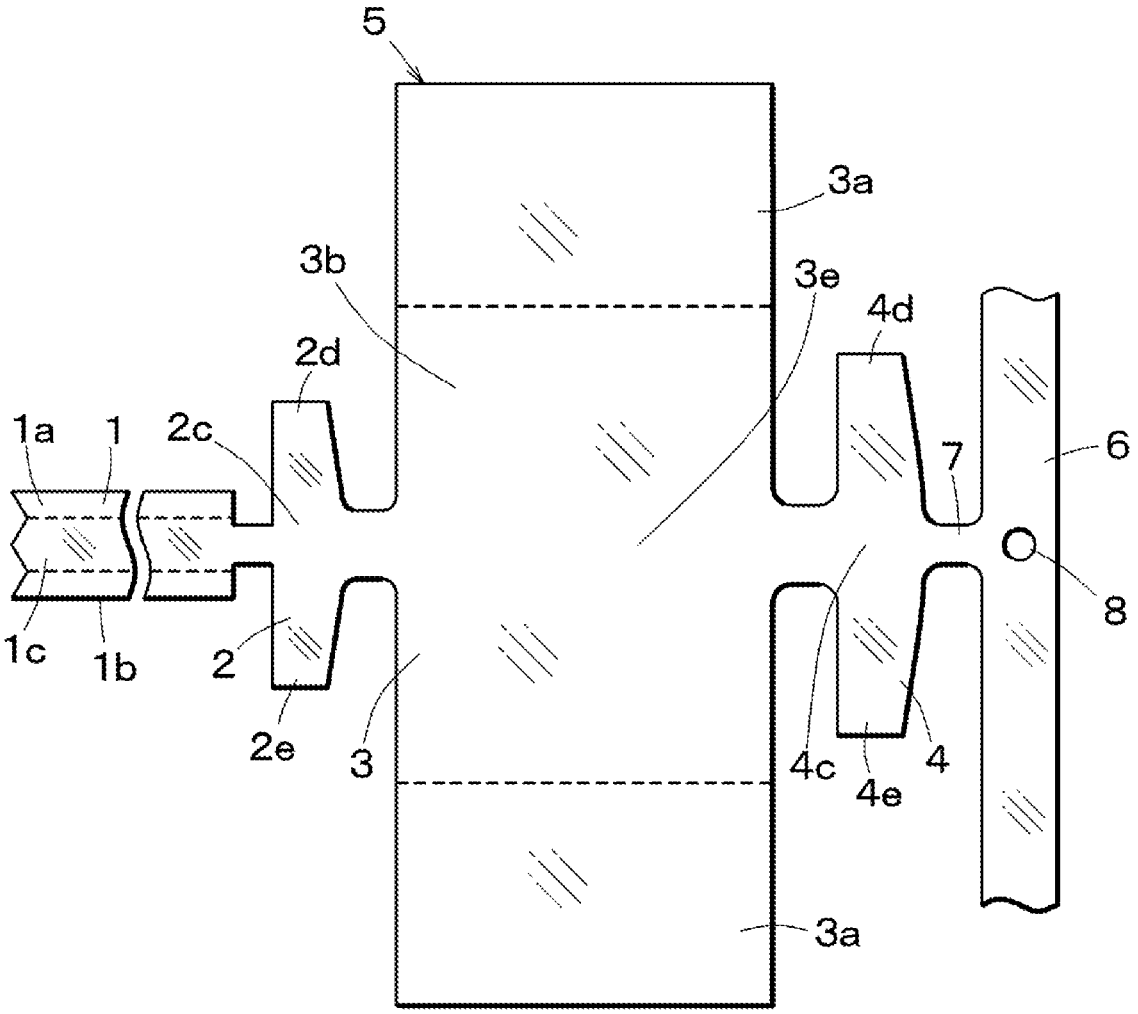
FIG. 3 is a plan view of a punched conductive metal plate.

FIG. 3 is a plan view of a state in which a conductive metal plate 5 is punched before being molded into the crimp connection terminal illustrated in FIG. 1.

In the connection portion 1, to form an insertion end of a double structure, the folded pieces 1*a* and 1*b* serving as upper plates are provided on a bottom portion 1*c* serving as a lower plate from both sides.

In the edge crimping portion 2, side portions 2*d* and 2*e* serving as the crimping pieces 2*a* and 2*b* are projected on both sides of the bottom portion 2*c*.

The conductor crimping portion 3 includes the lower layer plate 3*b* disposed at a center and the upper layer plates 3*a* continuous with both sides of the lower layer plate 3*b*. A dotted line is an inner fold line at which the upper layer plate 3*a* is folded back in a forming press described later.

In the coated crimping portion 4, side portions 4*d* and 4*e* serving as the crimping pieces 4*a* and 4*b* are projected on both sides of the bottom portion 4*c*.

A feed piece 6 for connecting the crimp connection terminals connected in a punched state is provided further to a rear of the coated crimping portion 4, and the coated crimping portion 4 at a rear end of each crimp connection terminal is connected to the feed piece 6 by a connection piece 7. A pilot hole 8 provided in the feed piece 6 is used to convey the conductive metal plate 5 in a molding process.

The conductive metal plate 5 punched out as illustrated in FIG. 3 is, for example, successively bent in each molding step by the forming press while being conveyed by the feed piece 6 after being chamfered or surface-treated as necessary, and is molded into the crimp connection terminal illustrated in FIG. 1. After this molding, the connection piece 7 is cut, and each crimp connection terminal is individually separated.

Figure 4:
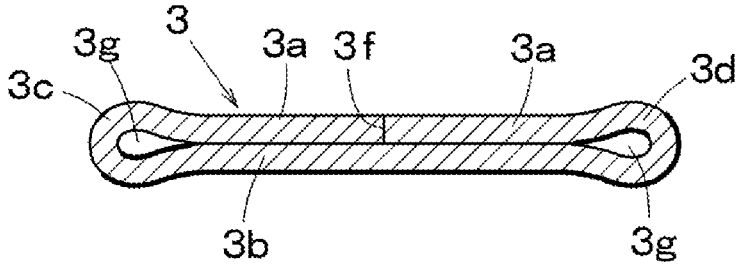
FIG. 4 is a cross-sectional view of the conductor crimping portion in one process of a bending process.

FIG. 4 is a cross-sectional view of the conductor crimping portion 3 in one process of this bending process, and illustrates a state immediately before the crimping pieces 3*c* and 3*d* are raised. In this state, the void 3*g* is formed inside a folded-back portion from the lower layer plate 3*b* of the upper layer plate 3*a* at a distal end of each of the crimping pieces 3*c* and 3*d*. A shape of the void 3*g* can be set to various shapes. However, it is easy to normally set to shape to a water droplet shape.

Figure 5:
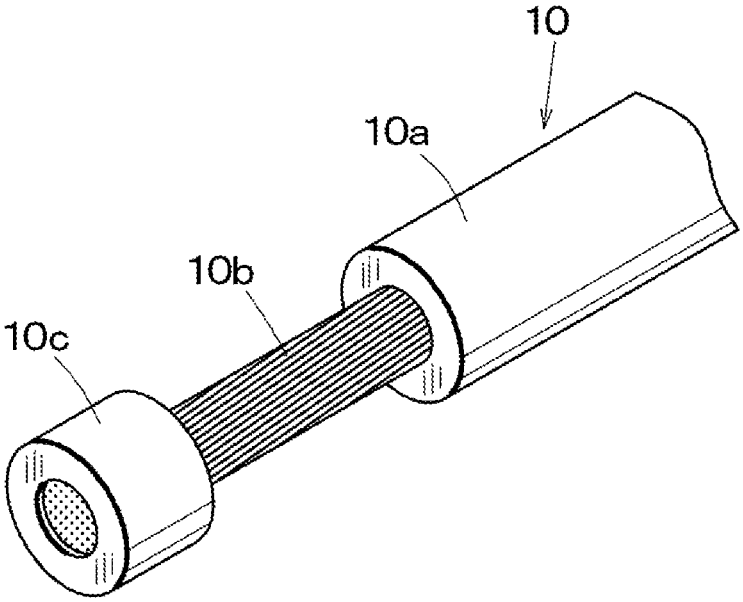
FIG. 5 is a perspective view of an electric wire in a state in which a part of an insulating covering portion is left at a distal end.

FIG. 5 is a perspective view of an electric wire 10 in a state in which an insulating covering portion 10*a* is peeled off from a conductor portion 10*b*. For example, the electric wire 10 used is a so-called fiber wire, and is obtained by applying copper plating as metal plating of about a thickness of 1 μm to an individual core wire including, for example, an aramid fiber filament having a diameter of about 20 μm and twisting, for example, 130 core wires together. A diameter of the conductor portion 10*b* of the electric wire 10 is set to about 0.3 mm, and an outer diameter of the electric wire 10 including the insulating covering portion 10*a* is set to about 0.7 to 0.8 mm.

In the conductor portion 10*b*, the insulating covering portion 10*a* is cut and drawn out by a cutter in a circumferential shape, a rear end portion remains at the distal end of the conductor portion 10*b*, and a front end portion protruding from the conductor portion 10*b* is cut. Therefore, a remaining portion 10*c*, which is a part of the insulating covering portion 10*a*, is attached to the distal end of the exposed conductor portion 10*b*, and the conductor portion 10*b* does not come apart.

Figure 6:
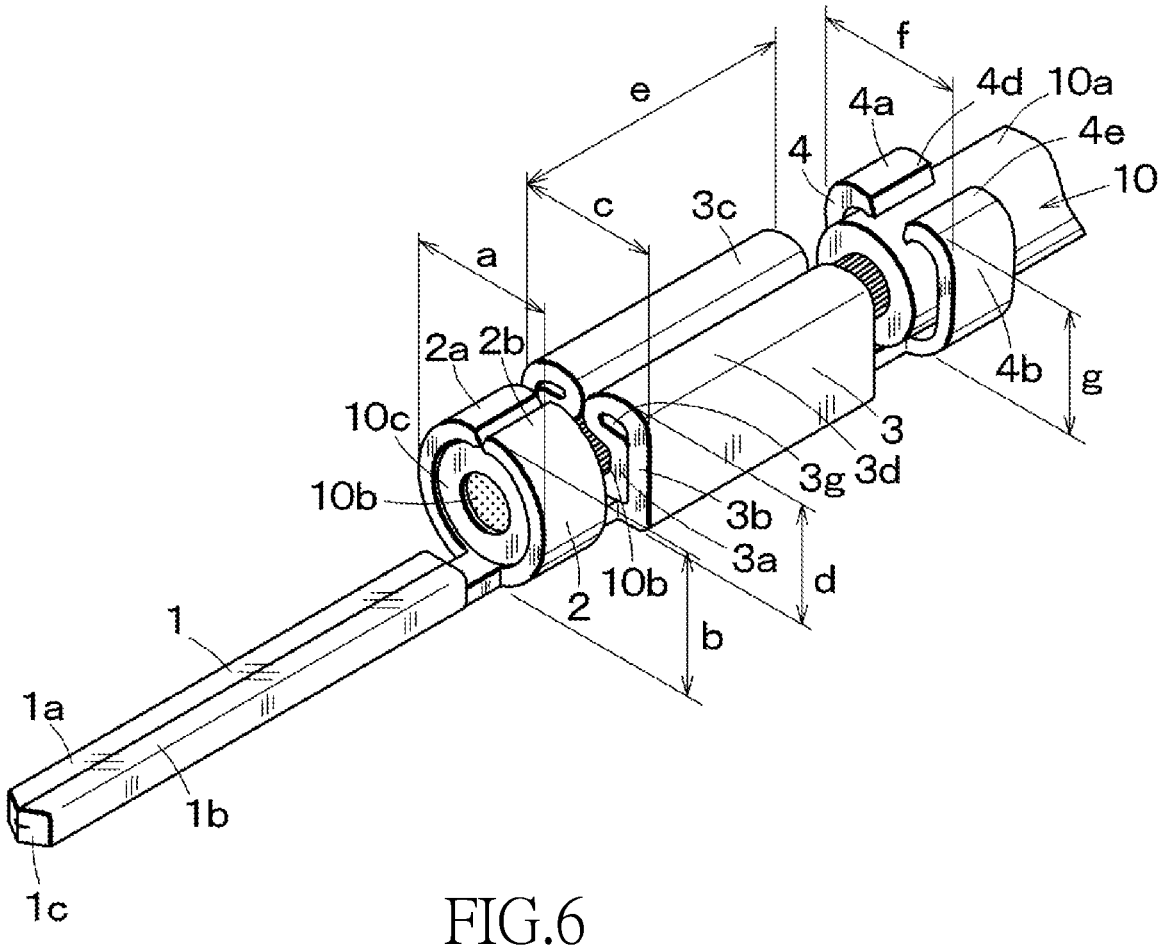
FIG. 6 is a perspective view of the crimp connection terminal in a state in which the electric wire is fixed.

FIG. 6 is a perspective view of a state in which the electric wire 10 illustrated in FIG. 5 is crimped and fixed by the crimp connection terminal illustrated in FIG. 1 using an electric wire crimping device. The remaining portion 10*c* of the electric wire 10 is crimped and fixed by the edge crimping portion 2 together with the conductor portion 10*b*. In the conductor crimping portion 3, the conductor portion 10*b* exposed between the remaining portion 10*c* and the insulating covering portion 10*a* is crimped. The insulating covering portion 10*a* of the electric wire 10 is crimped and fixed by the coated crimping portion 4.

With regard to illustrative dimensions of each portion of the crimp connection terminal after crimping the electric wire 10, a width a of the edge crimping portion 2 is about 0.9 mm, a height b thereof is about 1.2 mm, a width c of the conductor crimping portion 3 is about 1.0 mm, a height d thereof is about 0.75 mm, a length e thereof is about 4.5 mm, a width f of the coated crimping portion 4 is about 1.1 mm, and a height g thereof is about 1.5 mm.

Figure 7:
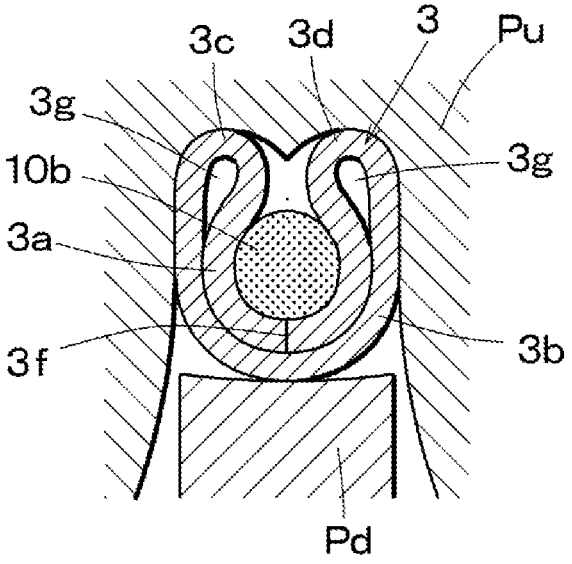
FIG. 7 is an explanatory diagram for a crimping process of a conductor portion by the conductor crimping portion.

In a crimping process of the conductor portion 10*b* by the electric wire crimping device, as illustrated in a cross-sectional view of FIG. 7, in a state in which the conductor portion 10*b* is inserted between the pair of crimping pieces 3*c* and 3*d* of the conductor crimping portion 3, upper ends of the crimping pieces 3*c* and 3*d* are closed by an upper press mold Pu and a lower press mold Pd and crushed, thereby performing caulking and holding such that the conductor portion 10*b* is wrapped with the crimping pieces 3*c* and 3*d*.

Figure 8:
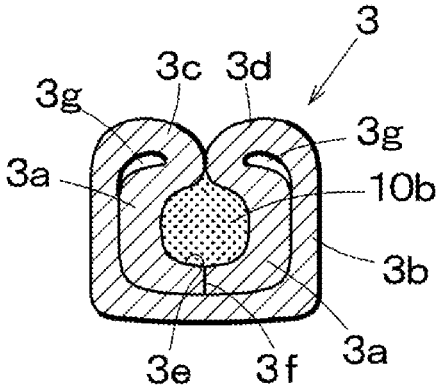
FIG. 8 is a cross-sectional view of the conductor crimping portion in a state in which the conductor portion is fixed.

Since the crimping pieces 3*c* and 3*d* have a two-layer structure of the upper layer plate 3*a* and the lower layer plate 3*b* stacked in two layers, and further have the void 3*g* contributing to elasticity, the crimping pieces 3*c* and 3*d* have a large elastic force. Further, when a strong crimping force is applied by the upper press mold Pu and the lower press mold Pd, as illustrated in FIG. 8, the conductor portion 10*b* is elastically deformed through the crimping pieces 3*c* and 3*d*, the void 3*g* itself is reduced to be flat, and the conductor portion 10*b* is firmly tightened and fixed without a gap. In this instance, the upper layer plate 3*a* in contact with the conductor portion 10*b* is compressed by being surrounded by the lower layer plate 3*b*, and thus is sufficiently in close contact with the conductor portion 10*b* due to occurrence of deformation in which a thickness increases.

As described above, according to the crimp connection terminal of the present embodiment suitable for the fiber wire, the conductor portion 10*b* in which a large number of core wires is twisted together can be elastically reliably crimped and connected by the crimping pieces 3*c* and 3*d* having a two-layer structure and the void 3*g*.

In the coated crimping portion 4, in particular, the side portions 4*d* and 4*e* of the coated crimping portion 4 are crimped by being engaged with the insulating covering portion 10*a* by caulking an outer side of the insulating covering portion 10*a* of the electric wire 10 using the pair of crimping pieces 4*a* and 4*b*. In this way, the insulating covering portion 10*a* can be fixed to resist a pulling force acting on the electric wire 10.

Figure 9:
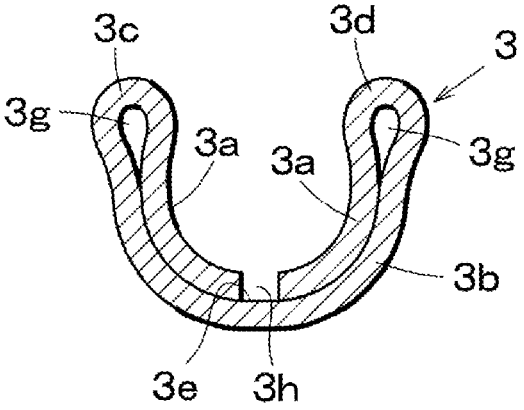
FIG. 9 is a cross-sectional view of a conductor crimping portion according to a modification.

FIG. 9 illustrates a modification of the conductor crimping portion 3, and a gap 3*h* is formed at a butted portion of the end edges of the upper layer plate 3*a* at the bottom portion 3*e*.

Figure 10:
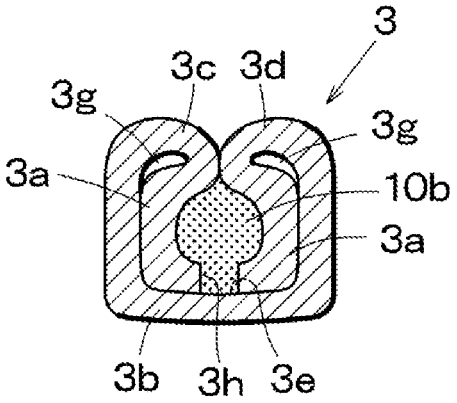
FIG. 10 is a cross-sectional view of the conductor crimping portion of the modification in a state in which the conductor portion is fixed.

FIG. 10 is a cross-sectional view of a state in which the conductor portion 10*b* is caulked by the conductor crimping portion 3. A part of the conductor portion 10*b* is deformed to enter the gap 3*h*, fixing of the conductor crimping portion 3 with respect to the conductor portion 10*b* becomes stronger, and an electrical characteristic becomes excellent.

REFERENCE SIGNS LIST

1 Connection portion
2 Edge crimping portion

2*a*, 2*b*, 3*c*, 3*d*, 4*a*, 4*b* Crimping piece
3 Conductor crimping portion
3*a* Upper layer plate
3*b* Lower layer plate
3*e* Bottom portion
3*f* Joint
3*g* Void
3*h* Gap
4 Coated crimping portion
5 Conductive metal plate
10 Electric wire
10*a* Insulating covering portion
10*b* Conductor portion

What is claimed is:

1. A crimp connection terminal formed by punching and bending one conductive metal plate to caulk and fix an electric wire, wherein a connection portion connected to a connection terminal of a counterpart connecter is disposed at a front side, a conductor crimping portion to crimp and fix a conductor portion of the electric wire is disposed at a rear side, the conductor crimping portion has a pair of crimping pieces raised in a U-shape from a bottom portion, each of the crimping pieces of the conductor crimping portion has a lower layer plate and an upper layer plate formed by folding back from an upper end portion of the lower layer plate toward an inner side of the lower layer plate and stacking on the lower layer plate, and a void is formed at a deformable folded-back portion between the lower layer plate and the upper layer plate contributing to elasticity, and the void has a cross-sectional shape of a water droplet, a balloon shape, a circular shape, or an elliptical shape;

wherein after the conductor crimping portion crimps the conductor portion of electric wire, upper ends of the crimping pieces are closed, and the shape of the void is reduced to be in a flat-shaped, so that the conductor portion is firmly tightened and fixed without a gap.

2. The crimp connection terminal according to claim 1, wherein the electric wire is a fiber wire.

3. The crimp connection terminal according to claim 1, wherein a gap is provided in a butted portion of end edges of the upper layer plate on the lower layer plate.

* * * * *